US009954310B2

(12) United States Patent
Ogasawara et al.

(10) Patent No.: US 9,954,310 B2
(45) Date of Patent: Apr. 24, 2018

(54) FIXING STRUCTURE FOR FUSE HOLDER AND FUSE COVER

(71) Applicant: Yazaki Corporation, Minato-ku, Tokyo (JP)

(72) Inventors: Shigeyuki Ogasawara, Kakegawa (JP); Shinichi Yanagihara, Kakegawa (JP); Michio Ota, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/412,634

(22) PCT Filed: Jun. 17, 2013

(86) PCT No.: PCT/JP2013/066596

§ 371 (c)(1),
(2) Date: Jan. 2, 2015

(87) PCT Pub. No.: WO2014/010374

PCT Pub. Date: Jan. 16, 2014

(65) Prior Publication Data

US 2015/0155655 A1 Jun. 4, 2015

(30) Foreign Application Priority Data

Jul. 10, 2012 (JP) ..... 2012-154913

(51) Int. Cl.
*H01R 13/627* (2006.01)
*H01R 33/95* (2006.01)
(Continued)

(52) U.S. Cl.
CPC ..... *H01R 13/6272* (2013.01); *H01H 85/2045* (2013.01); *H01R 13/447* (2013.01); *H01R 33/95* (2013.01); *H01H 85/547* (2013.01)

(58) Field of Classification Search
CPC .. H01R 13/447; H01R 33/95; H01H 85/2045; H01H 85/547
(Continued)

(56) References Cited

U.S. PATENT DOCUMENTS 3,840,152 A * 10/1974 Hodge ..... B65D 21/022 206/508
4,371,743 A * 2/1983 Decker ..... H01H 85/2045 174/535
(Continued)

FOREIGN PATENT DOCUMENTS

EP 1765047 A2 3/2007
JP 2-122515 U 10/1990
(Continued)

OTHER PUBLICATIONS

International Search Report dated Jul. 9, 2013 issued in International Application No. PCT/JP2013/066596 (PCT/ISA/210).
(Continued)

*Primary Examiner* — Edwin A. Leon
*Assistant Examiner* — Oscar Jimenez
(74) *Attorney, Agent, or Firm* — Sughrue Mion, PLLC

(57) ABSTRACT

A fuse cover lock 26 has a return portion that is inserted through a through hole, which is an engagement portion 42, so as to be brought into engagement with a step portion 44. In the return portion that is in engagement with the step portion 44, an end portion on a side facing a fuse cover 4 in an assembling direction of a fuse holder 2 to the fuse cover 4 is positioned near a circumferential edge of an opening of the through hole.

7 Claims, 4 Drawing Sheets

(51) Int. Cl.
*H01R 13/447* (2006.01)
*H01H 85/20* (2006.01)
*H01H 85/54* (2006.01)

(58) Field of Classification Search
USPC ..... 439/142
See application file for complete search history.

(56) References Cited

U.S. PATENT DOCUMENTS 4,752,243 A * 6/1988 Meidan ..... H01R 13/68 337/198
4,951,716 A * 8/1990 Tsunoda ..... H02G 3/0418 138/157
5,662,236 A * 9/1997 Sato ..... H01R 13/5213 220/3.8
5,691,878 A * 11/1997 Ahn ..... H05K 5/0013 174/DIG. 2
5,748,068 A * 5/1998 Kiyota ..... H01R 9/223 337/186
6,059,609 A 5/2000 Nieto
6,224,397 B1 * 5/2001 Nakamura ..... H01R 9/24 439/76.2
6,224,426 B1 5/2001 Kaneko
2002/0157847 A1 * 10/2002 Chiriku ..... B60R 16/0238 174/50
2005/0020106 A1 * 1/2005 Ito ..... H01H 85/2045 439/76.2
2005/0156469 A1 7/2005 Nishida et al.
2007/0149030 A1 * 6/2007 Kanamaru ..... H01R 13/506 439/352
2009/0033453 A1 2/2009 Deno et al.
2010/0053714 A1 * 3/2010 Shirai ..... G03G 15/04036 359/198.1

FOREIGN PATENT DOCUMENTS

JP 4-135121 U 12/1992
JP 2001-244660 A 9/2001
JP 2001-333519 A 11/2001
JP 2005-183285 A 7/2005
JP 2007-165765 A 6/2007
JP 2009-37778 A 2/2009
JP 2010-21055 A 1/2010
JP 2010-110031 A 5/2010

OTHER PUBLICATIONS

Written Opinion dated Jul. 9, 2013 issued in International Application No. PCT/JP2013/066596 (PCT/ISA/237).
Communication dated Feb. 19, 2016 by the European Patent Office in related Application No. 13817407.3.
Office Action dated Apr. 12, 2016, issued by the Japanese Intellectual Property Office in counterpart Japanese Application No. 2012-154913.

* cited by examiner

FIXING STRUCTURE FOR FUSE HOLDER AND FUSE COVER

TECHNICAL FIELD

The present invention relates to a fixing structure for assembling together a fuse holder that holds a fuse for use for a bus-bar module and a fuse cover.

BACKGROUND ART

Conventionally, a bus-bar module has been used widely as one of connecting circuits for electric parts. In the bus-bar module, a plurality of bus-bars that are formed by punching out of or bending a flat plate conductor are laid out on an insulated substrate. In using the bus-bar module, a fuse is connected to the bus-bar module to prevent a current out of rating from flowing to the bus-bar module, ensuring the safety. As this occurs, the fuse is held in a prescribed holding member (hereinafter, referred to as a fuse holder), and a cover member (hereinafter, referred to as a fuse cover) is assembled to the fuse holder for insulation. In assembling the fuse cover to the fuse holder, they are fixed to each other so as to be assembled together in such a way as not to be disassembled easily. Patent Document 1 discloses an example of a fixing structure like this.

In the fixing structure disclosed in Patent Document 1, a locking projection and an elastic locking arm are fastened together. In this case, the locking projection is provided on one of the two constituent box members that are assembled together and the elastic locking arm is provided on the other. In fixing the box members together, the elastic locking arm is moved in a fixing direction (that is, an assembling direction of the constituent box members). This causes a distal locking portion that is provided at a distal end of the elastic locking arm so as to project therefrom to strike the locking projection. Then, the elastic locking arm is elastically deflected and deformed to ride over the locking projection. Then, when the distal locking portion moves to a position where the distal locking portion rides over the locking projection completely, the elastic locking arm is deflected back to be restored, whereby the distal locking portion is locked to the locking projection.

In this fixing structure, however, the locking holding force only depends on the elastic restoring force of the elastic locking arm. Because of this, in the event that a strong unlocking force is exerted on the elastic locking arm that is being secured to be deflected and deformed, the locking of the distal locking portion and the locking projection is released. To cope with this, Patent Document 1 discloses a structure in which a rib that restricts the elastic locking arm from being elastically deflected and deformed (that is, an arm restricting rib) is provided in addition to the locking projection and the elastic locking arm. The arm restricting rib is disposed on a back side of the elastic locking arm that is locked to the locking projection, and hence, there is no such situation that the arm restricting rib interferes with the distal locking portion when the elastic locking arm moves in the fixing direction. On the other hand, in the event that the unlocking force is exerted on the elastic locking arm that is in the secured position, the arm restricting rib interferes with the elastic locking arm. This prevents the elastic locking arm from being displaced largely in the elastic deflecting direction. In this way, providing the arm restricting rib attempts to realize the fixing structure that is more difficult to be unfastened.

CITATION LIST

Patent Document

[Patent Document 1] JP 2007-165765 A

SUMMARY OF INVENTION

Technical Problem

In the fixing structure described above, however, since the rib needs to be provided, the installation space of the rib has to be ensured while considering a positional relationship with other parts (for example, installation position and the like). In addition, the provision of the rib calls for an increase in amount of resin used. Consequently, in realizing a reduction in size and weight of the fuse holder and the fuse cover, the problem remains.

The invention has been made in view of these situations, and the problem that the invention is to solve is how to save space for a fixing structure for assembling together a fuse holder and a fuse cover.

Solution to Problem

With a view to solving the problem, a fuse holder and fuse cover fixing structure according to the invention is characterized by the following points.

There is provided a fixing structure for assembling a fuse holder that holds a fuse to be connected to a bus-bar module with a fuse cover that insulates the fuse, wherein the fuse holder includes a projecting portion that is provided to be erected in an assembling direction with the fuse cover, wherein the fuse cover includes an engagement portion that is brought into engagement with the projecting portion, wherein the engagement portion is a through hole that penetrates the fuse cover along the assembling direction and the through hole has a step portion that is formed so as to be concave on an edge of an opening on a side facing the fuse cover in the assembling direction, and wherein the projecting portion has a return portion that is inserted through the through hole to be brought into engagement with the step portion and in the return portion that is in engagement with the step portion, an end portion on the side facing the fuse cover in the assembling direction is positioned near a circumferential edge of the opening of the through hole on the side facing the fuse cover.

According to the configuration described above, the projecting portion (specifically, the return portion) of the fuse holder is brought into engagement with the engagement portion (specifically, the step portion) of the fuse cover, whereby the fuse holder and the fuse cover can be assembled together. Additionally, even though an external force is exerted on the projecting portion in a direction in which the engagement with an inclining portion is released whereby the projecting portion is deflected and deformed in the engagement releasing direction, the end portion of the return portion interferes with the circumferential edge of the opening in the engagement portion. Thus, the state in which the fuse holder and the fuse cover are assembled together can be maintained without releasing the engagement between the projecting portion and the engagement portion.

In this case, a return length of the return portion in the assembling direction should be set substantially the same as a step height of the step portion in the assembling direction.

By doing so, the whole of the return portion can be positioned so as to interfere with the engagement portion.

Advantageous Effect of the Invention

According to the invention, it is possible to realize the saving of space for the fixing structure for assembling together the fuse holder and the fuse cover.

DESCRIPTION OF EMBODIMENTS

Hereinafter, a fixing structure of the invention for fixing a fuse holder and a fuse cover together (hereinafter, referred to simply as a fixing structure) will be described by reference to the accompanying drawings. The fixing structure is intended to assemble together a fuse holder that holds a fuse that is connected to a bus-bar module and a fuse cover that insulates the fuse. As one of its applications, the bus-bar module will be described as functioning as a circuit that connects together a power source device and a load (for example, an electric motor or the like) that are installed in a vehicle such as a motor vehicle. The bus-bar module can also be configured as a circuit that connects together other electric parts, and hence, any particular connection targets are not excluded. The bus-bar module should be formed by laying out a plurality of bus-bars that are made by punching out of or bending a flat conductor plate on an insulated substrate, and there is imposed no specific limitation on the shape thereof and the type and number of terminals.

Figure 1:
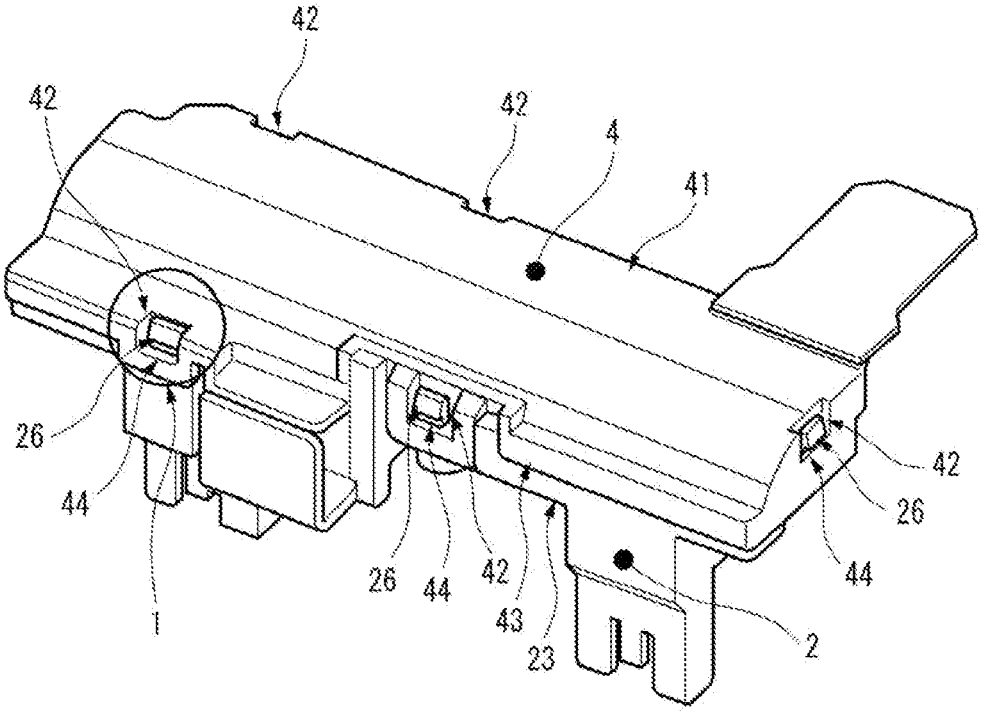
FIG. 1 is a view showing an overall configuration of a fuse holder and a fuse cover that are assembled together by a fixing structure according to an embodiment of the invention.
Figure 2:
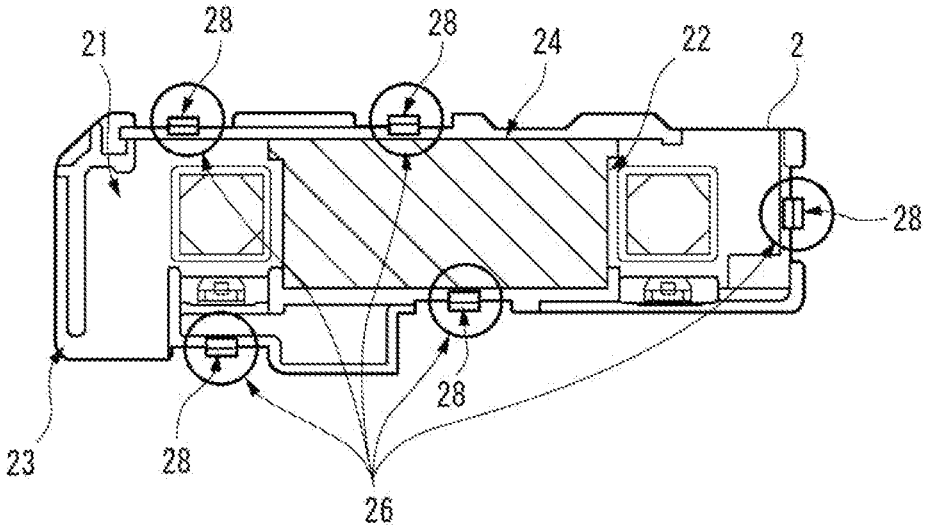
FIG. 2 is a plan view showing the configuration of the fuse holder.
Figure 3:
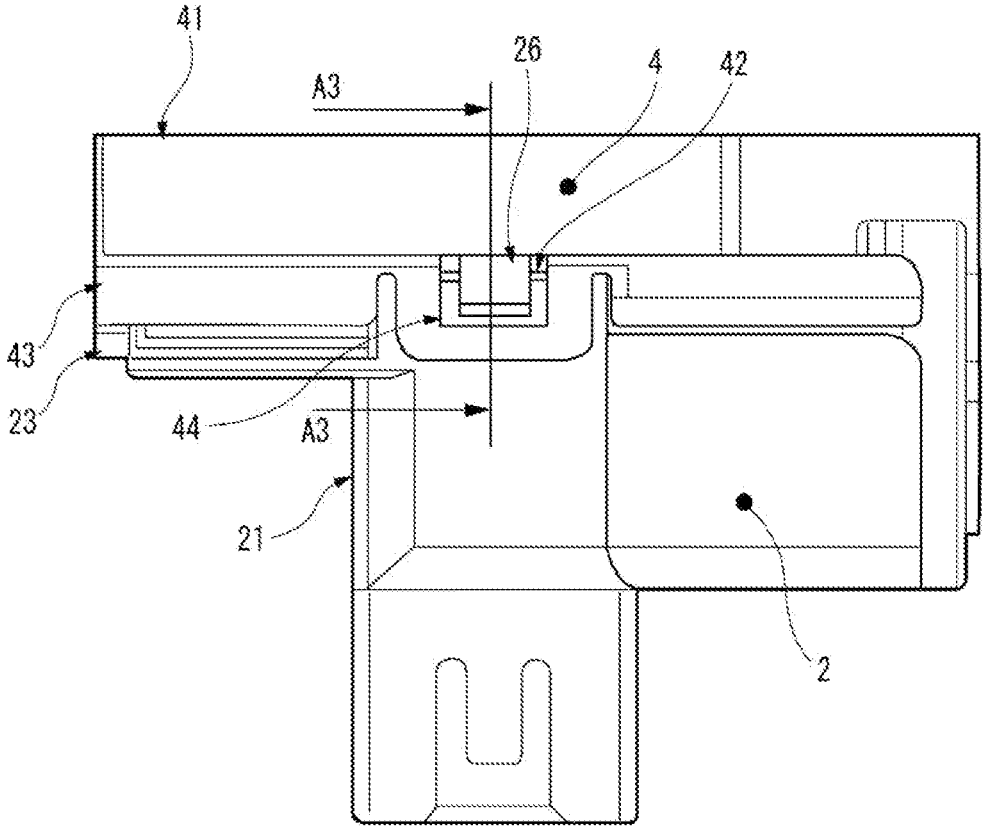
FIG. 3 is an enlarged view of a circled portion of the fixing structure shown in FIG. 1 as seen from the direction of the side of the fuse holder and the fuse cover that are assembled together.
Figure 4:
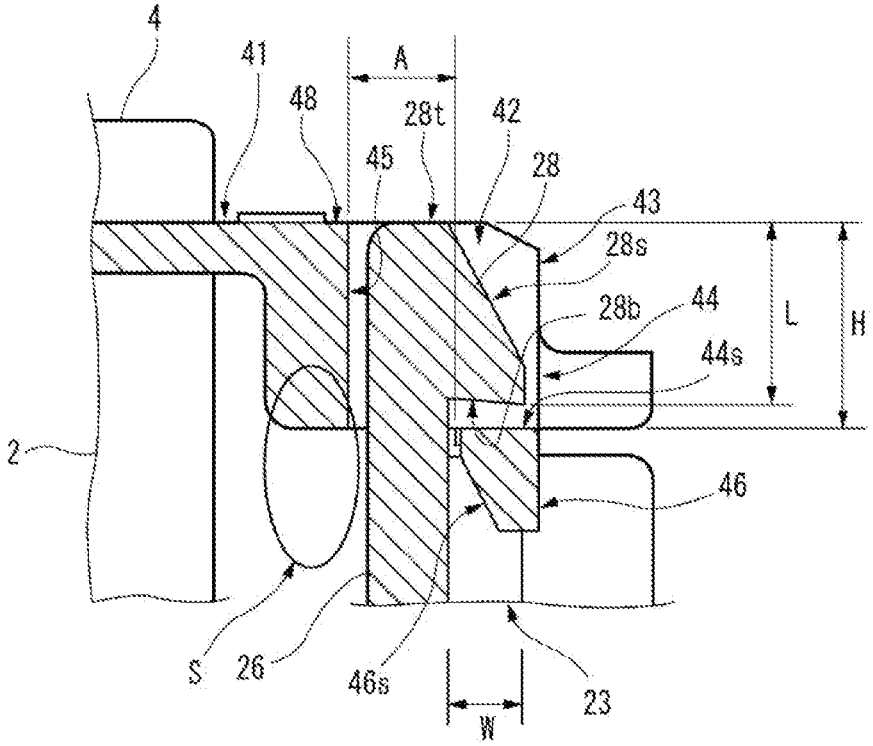
FIG. 4 is a view showing a vertical section of a portion indicated by arrows A3 in FIG. 3 as seen from a direction indicated by the arrows.

FIGS. 1 to 4 show the configuration of a fixing structure 1 according to an embodiment of the invention. FIG. 1 is a view showing an overall configuration of a fuse holder 2 and a fuse cover 4 that are assembled together by the fixing structure 1, FIG. 2 is a plan view showing the configuration of the fuse holder 2, FIG. 3 is an enlarged view of a circled portion of the fixing structure 1 shown in FIG. 1 as seen from the direction of the side of the fuse holder 2 and the fuse cover 4 that are assembled together, and FIG. 4 is a view showing a vertical section of a portion indicated by arrows A3 in FIG. 3 as seen from a direction indicated by the arrows. In the following description, in relation to a direction in which the fuse holder 2 and the fuse cover 4 are assembled together (as an example, a vertical direction in FIGS. 3 and 4), a fuse cover 4 side (as an example, an upper side in those figures) is referred to as a lid side, and a fuse holder 2 side (as an example, a lower side in those figures) is referred to as a bottom side.

The fuse holder 2 is a resin casing for holding a fuse and includes a bottom portion 21 that has an accommodating portion 22 where the fuse is accommodated and a frame portion 23 that is provided so as to extend from a circumferential edge of the bottom portion 21 towards the lid side. In the configuration shown in FIG. 2, the frame portion 23 is provided so as to extend along the full circumference of the bottom portion 21 while being erected upwards substantially perpendicularly. A fuse unit 24 is accommodated in the accommodating portion 22 of the frame portion 23 that is so provided. The fuse unit 24 includes a fuse, a fixing device (for example, a fixing metal piece, a screw or the like) for fixing the fuse in place in the accommodating portion 22 and a connecting terminal for connection with a bus-bar module. The accommodating portion 22 and the fuse unit 24 can be configured arbitrarily in terms of size and shape as long as the fuse unit 24 can be accommodated in the accommodating portion 22.

The fuse cover 4 is a resin cover member (that is, a covering element) that is assembled to the fuse holder 2 to insulate the fuse (the fuse unit 24). The fuse cover 4 includes a lid portion 41 that covers the bottom portion 21 of the fuse holder 2 and a wall portion 43 that is provided along the full circumference of the lid portion 41 so as to extend from a circumferential edge of the lid portion 41 towards the bottom side (as an example, substantially perpendicularly downwards). This wall portion 43 surrounds an external side of the frame portion 23 in an overlapping fashion. The fuse cover 4 is assembled to the fuse holder 2 in which the fuse unit 24 is accommodated in the accommodating portion 22 from perpendicularly thereabove. After having been assembled to the fuse holder 2, the fuse cover 4 is handled integrally with the fuse holder 2. This enables the fuse unit 24 to be connected to a bus-module easily. In addition, in such a state that the fuse holder 2 and the fuse cover 4 are assembled together, a space is defined in an interior thereof where the whole of the fuse unit 24 can be accommodated. In this embodiment, while the fuse holder 2 and the fuse cover 4 are described as being assembled together in the perpendicular direction, a fixing structure can be considered in which the fuse holder 2 and the fuse cover 4 are assembled together in a horizontal direction, and in this fixing structure, the fuse cover 4 is assembled to the fuse holder 2 from one side in the horizontal direction.

As the fixing structure 1 according to this embodiment, the fuse holder 2 includes projecting portions (hereinafter, referred to as fuse cover locks) 26 that are provided so as to project in the assembling direction of the fuse holder 2 to the fuse cover 4. Additionally, the fuse cover 4 includes engagement portions 42 that are brought into engagement with the fuse cover locks 26. As this occurs, at least either the fuse locks 26 or the engagement portions 42 are elastic. For example, the fuse cover locks 26 are formed of an elastic material (a resin material as an example) so as to be elastically deformed relative to the engagement portions 42. As this occurs, the whole of the fuse holder 2 or the frame portion 23 may be formed of the same elastic resin material as that of the fuse cover locks 26. By doing so, the fuse cover locks 26 are elastically deformed relative to the engagement portions 42 to thereby be brought into engagement with the engagement portions 42, whereby the fuse holder 2 and the fuse cover 4 are assembled together while being locked to each other. The cover locks 26 and the engagement portions 42 may be provided on the fuse holder 2 and the fuse cover 4, respectively, in a plural and equal number, and hence, there is imposed no specific limitation on the number thereof. FIGS. 1 and 2 show, as an example, the configuration of the fuse holder 2 and the fuse cover 4 that include five fuse cover locks 26 and five engagement portions 42, respectively. In this case, the fuse cover locks 26 are scattered along a circumferential edge portion (specifically, the frame portion 23) of the fuse holder 2 so as to surround the accommodating portion 22 of the fuse holder 2. The engagement portions 42 are scattered along a circumferential edge portion of the fuse cover 4 so as to be positioned to correspond to the fuse cover locks 26. By doing so, the fuse holder 2 and the fuse cover 4 are locked to each other at a plurality of locations (five locations as an example) along circumferential edges thereof to thereby be assembled together in a stable fashion.

The engagement portions 42 are through holes that penetrate the fuse cover 4 along the assembling direction (refer to FIGS. 3 and 4). Namely, the engagement portions 42 are formed as through holes that are opened to both the lid side and the bottom side in the assembling direction. The through holes each have a step portion 44 that is formed by making an edge of a lid-side opening concave towards the bottom side. Namely, the engagement portions 42 penetrate the fuse cover 4 in the assembling direction at the locations described above in such a state that a connecting portion between the lid portion 41 and the wall portion 43 is cut into a rectangular shape (that is, in such a state that part of the edge of the lid-side opening is made concave towards the bottom side). By adopting this configuration, hole wall portions 45 of the through holes are exposed to the outside at the step portions 44. Additionally, a guiding portion 46 is provided on each of the engagement portions 42 in such a way as to project from a step surface 44*s* of the step portion 44 towards the bottom side so as to guide the corresponding fuse cover lock 26. The guiding portion 46 has an inclined surface 46*s* that is inclined gradually from an inside to an outside (from a left side to a right side in FIG. 4) and is hence tapered as it extends towards the bottom side.

The fuse cover lock 26 is provided so as to be erected like a plate from the bottom portion 21 along the frame portion 23 of the fuse holder 2. In this case, the fuse cover lock 26 has a return portion 28 that is inserted through the corresponding through hole, which is the engagement portion 42, so as to be brought into engagement with the step portion 44 (more specifically, the step surface 44*s* thereof). The return portion 28 is provided near a lid-side end portion of the fuse cover lock 26 so as to project outwards (rightwards in FIG. 4). Additionally, the return portion 28 has an inclined surface 28*s* that is inclined gradually from an outside to an inside (from the right side to the left side in FIG. 4) and is hence tapered as it extends towards the lid side. Namely, the return portion 28 is tapered in an opposite direction to the direction in which the guiding portion 46 is tapered in relation to the assembling direction. By adopting this configuration, in inserting the fuse cover lock 26 through the through hole that is the engagement portion 42, the inclined surface 28*s* is brought into abutment with the inclined surface 46*s* of the guiding portion 46, whereby the return portion 28 moves smoothly along the inclined surface 46*s*. As a result of this, the fuse cover lock 26 (in short, the return portion 28) is easily guided to the engagement portion 42. As this occurs, an inclined angle of the inclined surface 28*s* of the return portion 28 in relation to the assembling direction is preferably set so that the inclined surface 28*s* is inclined along the inclined surface 46*s* of the guiding portion 46. The return portion 28 is provided so as to project from near the lid-side end portion of the fuse cover lock 26 in the assembling direction to thereby be brought into engagement with the step portion 44. For example, the return portion 28 is configured so that the return portion 28 can be brought into engagement with the step portion 44 over a width along which the return portion 28 projects outwards (that is, a distance W shown in FIG. 4). In other words, the return portion 28 is configured so that the whole of a return surface 28*b* can be brought into engagement with the step surface 44*s*. A width of the step surface 44*s* (that is, a horizontal distance in FIG. 4) corresponds to a thickness of a proximal end portion of the guiding portion 46.

In the return portion 28, with the fuse cover lock 26 brought into engagement with the step portion 44, a lid-side end portion 28*t* in the assembling direction is positioned near a circumferential edge 48 of the lid-side opening of the through hole that is the engagement portion 42. As this occurs, the return portion 28 is set so that a return length in the assembling direction (that is, a distance L shown in FIG. 4) is substantially the same as a step height of the step portion 44 in the assembling direction (that is, a distance H shown in FIG. 4). The return length L of the return portion 28 corresponds to a distance from the lid-side end portion 28*t* to the return surface 28*b*. The step height H of the step portion 44 corresponds to a distance from the circumferential edge 48 of the opening to the step surface 44*s*. Here, in FIG. 4, although a difference between the return length L of the return portion 28 and the step height H of the step portion 44 is exaggerated (that is, larger than in reality) to describe the return length L and the step height H, the return length L and the step height H should be set to substantially the same dimension. Namely, the return length L of the return portion 28 corresponds to substantially the same dimension as a thickness of the fuse cover 4 in the assembling direction at the portion where the lid portion 41 continues to the wall portion 43. By doing so, the height of the fuse cover lock 26, the height of the fuse cover 4 (specifically, the height of the lid-side end portion 28*t*) and the height of the lid portion 41 in the assembling direction are substantially the same. Namely, the return portion 28 is positioned in relation to the engagement portion 42 so that the lid-side end portion 28*t* is substantially level with the lid portion 41 (the portion lying near the circumferential edge 48 of the opening) of the fuse cover 4. As this occurs, the whole of the return portion 28 can interfere with the hole wall portion 45 of the engagement portion 42.

Here, in assembling the fuse holder 2 and the fuse cover together, the fuse cover locks 26 and the engagement portions 42 (more specifically, the return portions 28 and the step portions 44) should be brought into engagement with each other according to the following procedure as an example.

Hereinafter, although the assembling work will be described as being executed by a working person, part or the whole of the assembling work may be executed mechanically.

First of all, the working person rests the fuse holder 2 in which the fuse unit 24 is accommodated in the accommodating portion 22 and positions the fuse cover 4 in one of the assembling directions (as an example, perpendicularly above) in relation to the fuse holder 2 so that the lid portion 41 is aligned with the bottom portion 21. The working person moves the fuse cover 4 from this state towards the bottom side (as an example, perpendicularly downwards) while aligning the positions of the engagement portions 42 with the positions of the fuse cover locks 26 and brings the inclined surfaces 46*s* of the guiding portions 46 into abutment with the inclined surfaces 28*s* of the return portions 28 of the fuse cover locks 26. Then, the working person exerts a pressing force on the fuse cover 4 towards the bottom side and causes the pressing force that is exerted from the inclined surfaces 46*s* via the inclined surfaces 28*s* to be exerted on the return portions 28, so as to elastically deflect and deform the fuse cover locks 26 inwards (as an example, leftwards in FIG. 4).

Keeping the pressing force exerted in this way, the working person moves the fuse cover 4 towards the bottom side so that the return portions 28 of the fuse cover locks 26 that are elastically deflected and deformed are inserted into the engagement portions 42 (the through holes) while allowing them to slide on the inclined surfaces 28*s* along the inclined surfaces 46*s*. Then, the working person moves the fuse cover 4 towards the bottom side until the inclined surfaces 28*s* eventually pass the inclined surfaces 46*s*. When the fuse cover 4 is so moved until the aforesaid state results, the pressing forces that are exerted on the return portions 28 from the inclined surfaces 46*s* via the inclined surfaces 28*s* are no more exerted thereon, whereby the fuse cover locks 26 are elastically deflected and deformed back outwards to be restored to their initial states.

This brings the fuse cover locks 26 into engagement with the engagement portions 42. More specifically, the return surfaces 28*b* of the return portions 28 are brought into engagement with the step surfaces 44*s* of the step portions 44. That is, the fuse holder 2 and the fuse cover 4 can be assembled together while they are being locked to each other.

In assembling the fuse holder 2 and the fuse cover 4 together in the way described above, it is also considered that the guiding portions 46 are elastically deflected and deformed outwards (as an example, rightwards in FIG. 4).

There may be a case where a force is exerted which attempts to cause the fuse holder 2 and the fuse cover 4 to move away from each other in relation to the assembling direction (hereinafter, referred to as an unlocking force) in such a state that the fuse holder 2 and the fuse cover 4 are assembled together in the way described above. For example, in the event that an unlocking force is exerted which attempts to move the fuse cover 4 towards the lid side (as an example, perpendicularly upwards), the return surfaces 28*b* of the return portions 28 interfere with the step surfaces 44*s* of the step portions 44, this exerting a force that elastically deflects and deforms the fuse cover locks 26 inwards.

In this embodiment, however, as has been described above, the lid-side end portions 28*t* of the return portions 28 are positioned near the circumferential edges 48 of the openings of the engagement portions 42. That is, in the fuse cover locks 26, the return portions 28 are held between the step portions 44 and the circumferential edges 48 of the openings and the hole wall portions 45 (a gap A shown in FIG. 4) in the through holes which are the engagement portions 42. Even though the fuse cover locks 26 are elastically deflected and deformed inwards from the state in which the fuse cover locks 26 are in engagement with the engagement portions 42, the aforesaid configuration causes the fuse cover locks 26 to interfere with the circumferential edges 48 of the openings and the hole wall portions 45 of the engagement portions 42. This restricts the fuse cover locks 26 from being elastically deflected and deformed further inwards. Consequently, this can prevent the engagement of the return surface 28*b* of the return portion 28 with the step surface 44*s* of the step portion 44 from being released, whereby the fuse holder 2 and the fuse cover 4 can maintain their assembled state. As this occurs, the fuse cover locks 26 are caused to interfere with the circumferential edges 48 of the openings of the engagement portions 42, and therefore, the engagement portions 42 can be configured with the hole wall portions 45 omitted.

In this way, according to the fixing structure 1 of the embodiment, the elastic deflection and deformation of the fuse cover locks 26 can be restricted only by the engagement portions 42 (that is, the circumferential edges 48 of the openings and the hole wall portions 45). This obviates the necessity of separately providing rib members or the like that restrict the elastic deflection and deformation of the fuse lock covers 26 on the fuse cover 4. Consequently, no space for installing rib members or the like (for example, a space S defined within an ellipse shown in FIG. 4) has to be ensured, thereby making it possible to realize the saving of space for the fixing structure 1. In addition, an increase in amount of a resin used for provision of such rib members or the like does not have to be called for. That is, according to the fixing structure 1, the fuse holder 2 and the fuse cover 4 can maintain their assembled state, and it is also possible to realize a reduction in size and weight of the fuse holder 2 and the fuse cover 4.

Hereinafter, the fuse holder and fuse cover fixing structure 1 according to the embodiment will be summarized.

(1) The fixing structure 1 is the fixing structure 1 that is intended to assemble together the fuse holder 2 that holds the fuse unit 24 (the fuse) that is connected to a bus-bar module and the fuse cover 4 that insulates the fuse unit 24. The fuse holder 2 includes the projecting portions 26 (the projecting portions) that are provided to be erected in the assembling direction with the fuse cover 4, and the fuse cover 4 includes the engagement portions 42 that are brought into engagement with the fuse cover locks 26. The engagement portions 42 are the through holes that penetrate the fuse cover 4 along the assembling direction, and the through holes each have the step portion 44 that is formed by making concave the edge of the opening on the side facing the fuse cover 4 in the assembling direction. The fuse cover locks 26 each have the return portion 28 that is inserted through the through hole to be brought into engagement with the step portion 44, and in the return portion 28 that is in engagement with the step portion 44, the end portion 28*t* (the end portion) on the side facing the fuse cover 4 in the assembling direction is positioned near the circumferential edge 48 of the opening of the through hole on the side facing the fuse cover 4.

(2) The return length of the return portion 28 in the assembling direction is set substantially the same as the step height of the step portion 44 in the assembling direction.

This patent application is based on Japanese Patent Application (No. 2012-154913) filed on Jul. 10, 2012, the contents of which are incorporated herein by reference.

INDUSTRIAL APPLICABILITY

According to the fuse holder and fuse cover fixing structure of the invention, it is useful in realizing the saving of space for the fixing structure.

REFERENCE SIGNS LIST

1 fixing structure
2 fuse holder
4 fuse cover
26 projecting portion (fuse cover lock)
28 return portion
28*t* lid-side end portion of return portion
42 engagement portion
44 step portion
48 circumferential edge of lid-side opening of engagement portion

The invention claimed is:

1. A fixing structure for assembling a fuse holder that holds a fuse to be connected to a bus-bar module with a fuse cover that insulates the fuse wherein the fuse holder and the fuse cover are assembled to one another in an assembling direction in which the fuse holder and the fuse cover face each other, wherein the fuse holder includes a projecting portion that extends from the fuse holder in the assembling direction, wherein the fuse cover includes an engagement portion that is brought into engagement with the projecting portion, wherein the engagement portion is a through hole that penetrates the fuse cover along the assembling direction, and the through hole has a step portion that is formed so as to be concave on an edge of an opening on a side facing the fuse cover in the assembling direction, wherein the projecting portion has a return portion that is inserted through the through hole to be brought into engagement with the step portion, and in the return portion that is in engagement with the step portion, an end portion on the side facing the fuse cover in the assembling direction is positioned near a circumferential edge of the opening of the through hole on the side facing the fuse cover, wherein the engagement portion includes a guiding portion that projects from a step surface of the step portion towards a bottom side so as to guide the projecting portion, wherein the guiding portion has an inclined surface that is inclined gradually from an inside to an outside toward a guiding direction, and wherein a height of the return portion to a top surface of the return portion in the assembling direction is the same as a height of the step portion to a top surface of the step portion in the assembling direction.

2. The fixing structure according to claim 1, wherein a return length of the return portion in the assembling direction is set substantially the same as a step height of the step portion in the assembling direction.

3. The fixing structure according to claim 1, wherein the return portion is tapered in an opposite direction to a direction in which the guiding portion is tapered in relation to the assembling direction.

4. The fixing structure according to claim 1, wherein the fuse holder, the fuse cover, and the fuse are integrally removable from the bus bar module.

5. The fixing structure according to claim 1, wherein the return portion is displaced from the fuse holder in the assembling direction.

6. The fixing structure according to claim 1, wherein a width of a return surface of the return portion is set substantially the same as a width of the step surface of the step portion.

7. A fixing structure for assembling a fuse holder that holds a fuse to be connected to a bus-bar module with a fuse cover that insulates the fuse wherein the fuse holder and the fuse cover are assembled to one another in an assembling direction, wherein the fuse holder includes a projecting portion that extends from the fuse holder in the assembling direction, wherein the fuse cover includes an engagement portion that is brought into engagement with the projecting portion, wherein the engagement portion is a through hole that penetrates the fuse cover along the assembling direction and opens into a concave recess formed in an exterior wall portion of the fuse cover so as to provide a step portion having a step surface provided along an edge of an opening of the through hole on a side facing the fuse cover in the assembling direction, wherein the projecting portion has a return portion that is inserted through the through hole and into the concave recess so as to be brought into engagement with the step portion, and in the return portion that is in engagement with the step portion, an end portion on the side facing the fuse cover in the assembling direction is positioned near a circumferential edge of the opening of the through hole on the side facing the fuse cover, wherein the engagement portion includes a guiding portion that projects from the step surface of the step portion towards a bottom side so as to guide the projecting portion, wherein the guiding portion has an inclined surface that is inclined gradually from an inside to an outside toward a guiding direction, and wherein a height of the return portion to a top surface of the return portion in the assembling direction is the same as a height of the step portion to a top surface of the step portion in the assembling direction.

* * * * *